US006077316A

United States Patent [19]

Lund et al.

[11] Patent Number: 6,077,316

[45] Date of Patent: Jun. 20, 2000

[54] TREATMENT OF FABRICS

[75] Inventors: Henrik Lund, Copenhagen N; Thomas Erik Nilsson, Copenhagen Ø, both of Denmark; Tom Pickard, Rossendale, United Kingdom

[73] Assignee: Novo Nordisk A/S, Bagsvaerd, Denmark

[21] Appl. No.: 09/008,391

[22] Filed: Jan. 16, 1998

Related U.S. Application Data

[63] Continuation of application No. PCT/DK96/00311, Jul. 9, 1996.

[30] Foreign Application Priority Data

Jul. 19, 1995 [DK] Denmark ..... 0845/95

[51] Int. Cl.[7] ..... C11D 3/386; D06M 13/325

[52] U.S. Cl. ..... 8/115.6; 510/320; 510/321; 510/392; 510/530

[58] Field of Search ..... 8/115.6, 138; 510/320, 510/321, 392, 530

[56] References Cited

U.S. PATENT DOCUMENTS

| | | | |
|---|---|---|---|
| 3,944,470 | 3/1976 | Diehl et al. | 195/63 |
| 4,011,169 | 3/1977 | Diehl et al. | 252/95 |
| 4,421,664 | 12/1983 | Anderson et al. | 252/94 |
| 4,457,760 | 7/1984 | Cholley | 8/111 |
| 4,536,182 | 8/1985 | Tatin | 8/107 |
| 4,712,290 | 12/1987 | Lindsey | 28/178 |
| 4,876,024 | 10/1989 | Enomoto et al. | 252/174.12 |
| 5,736,499 | 4/1998 | Mitchinson et al. | 510/392 |
| 5,763,385 | 6/1998 | Bott et al. | 510/392 |
| 5,769,900 | 6/1998 | Hahn et al. | 8/138 |

FOREIGN PATENT DOCUMENTS

| | | |
|---|---|---|
| WO 88/02775 | 4/1988 | WIPO . |
| 93/13256 | 7/1993 | WIPO . |
| WO 93/13256 | 7/1993 | WIPO . |
| 97/04160 | 2/1997 | WIPO . |

*Primary Examiner*—Kery Fries
*Attorney, Agent, or Firm*—Steve T. Zelson; Carol E. Rozek; Valeta Gregg

[57] ABSTRACT

This invention relates to a process for the treatment of fabrics. More specifically the invention relates to a process for the treatment of fabrics, which process comprises treating the fabric at elevated temperatures with an effective amount of a thermostable lipolytic enzyme.

18 Claims, No Drawings

TREATMENT OF FABRICS

CROSS-REFERENCE TO RELATED APPLICATIONS

This application is a continuation of PCT/DK96/00311 filed Jul. 9, 1996 which claims priority under 35 U.S.C. 119 of Danish application serial No. 0845/95 filed Jul. 19, 1995, the contents of which are fully incorporated herein by reference.

FIELD OF THE INVENTION

This invention relates to a process for the treatment of fabrics. More specifically the invention relates to a process for the treatment of fabrics, which process comprises treating the fabric at elevated temperatures with an effective amount of a thermostable lipolytic enzyme.

BACKGROUND ART

During the weaving of textiles, the threads are exposed to considerable mechanical strain. Prior to weaving on mechanical looms, warp yarns are often coated with size starch or starch derivatives in order to increase their tensile strength and to prevent breaking. The most common sizing agent is starch in native or modified form, yet other polymeric compounds such as polyvinylalcohol (PVA), polyvinylpyrrolidone (PVP), polyacrylic acid (PAA) or derivatives of cellulose (e.g. carboxymethylcellulose (CMC), hydroxyethylcellulose, hydroxypropylcellulose or methylcellulose), may also be abundant in the size.

In general, after the textiles have been woven, the fabric proceeds to a desizing stage, followed by one or more additional fabric processing steps. Desizing is the act of removing size from textiles. After weaving, the size coating must be removed before further processing the fabric in order to ensure a homogeneous and wash-proof result. The preferred method of desizing is enzymatic hydrolysis of the size by the action of amylolytic enzymes.

Increasing amounts of cotton wax and other lubricants are applied to yarns in order to increase the speed of cotton weaving. Also waxes of higher melting points are being introduced. Wax lubricants are hydrophobic substances obtained by esterification of long chain alcohols and fatty acids, and they are predominantly triglyceride ester based lubricants. After desizing, the wax either remains or redeposits on the fabric and as a result, the fabric gets darker in shade, gets glossy spots, and becomes more stiff.

International Patent Application No. WO 93/13256 (Novo Nordisk A/S) describes a process for the removal of hydrophobic esters from fabric, in which process the fabric is impregnated during the desizing step with an aqueous solution of lipase. This process has been developed for use in the fabric mills only, and is carried out using existing fabric mill equipment, i.e. a pad roll, a jigger, or a J box.

For the manufacture of clothes, the fabric is cut and sewn into clothes or garments, that is afterwards finished. In particular, for the manufacture of denim jeans, different enzymatic finishing methods have been developed. The finishing of denim garment normally is initiated with an enzymatic desizing step, during which garments are subjected to the action of amylolytic enzymes in order to provide softness to the fabric and make the cotton more accessible to the subsequent enzymatic finishing steps.

For many years denim jeans manufacturers have washed their garments in a finishing laundry with pumice stones to achieve a soft-hand as well as a desired fashionable "stone-washed" look. This abrasion effect is obtained by locally removing the surface bound dyestuff. Recently cellulytic enzymes have been introduced into the finishing process, turning the stone-washing process into a "bio-stoning process".

The goal of a bio-stoning process is to obtain a distinct, but homogeneous abrasion of the garments (stone-washing appearance). However, the dark shades arising from wax on the fabric greatly reduce the stone-washing quality, and the stiffness of the fabric causes more rigid folds. As a result, uneven stone-washing ("streaks" and "creases") occur. In consequence repair work ("after-painting") is needed on a major part (up to about 80%) of the stone-washed jeans that have been processed in the finishing laundries.

The problem of streaks and creases on the finished garments can generally be traced back to the desizing step. Initially the fabric is stiff and very often creases have been formed on the garments during packing and transport. Streaks are rapidly formed at exposed places—such as creases—if the garment is abraded when still stiff. Therefore it is very important that denim garments are quickly softened in an efficient desizing and/or finishing process.

SUMMARY OF THE INVENTION

It is an object of the present invention to provide a process for the treatment of fabrics, which process improves the finishing quality, including softness, color distribution/uniformity, stone-wash quality, etc., and which reduces the need for after-painting of the finished clothes.

Accordingly the invention provides a process for enzymatic removal of hydrophobic esters from fabrics, which process comprises treating the fabric with an effective amount of a thermostable lipolytic enzyme at an elevated temperature, i.e. a temperature that exceeds the melting point of the lubricant applied to the fabric.

DETAILED DISCLOSURE OF THE INVENTION

Enzymatic Treatment of Fabrics

The present invention provides a process for enzymatic treatment of fabrics, by which process hydrophobic esters are removed from the fabric.

Experience from textile finishing processes have revealed that the currently used processes for removal of hydrophobic esters from the fabric does not efficiently avoid the problem of streaks and creases on the final product. Our studies have now shown that this problem is due to the use of increasing amounts of lubricants of high melting point. In the existing processes only limited saponification takes place, why these high melting lubricants are not sufficiently accessible to the enzyme and therefore are not totally removed from the fabric.

According to our studies it has now been found that the enzymatic treatment must be carried out at a temperature that exceeds the melting point of the lubricant. A major part of the presently used lubricants is found to have melting points above 50° C., and an increasing part of the lubricants applied to the yarn has melting points as high as above 60° C., or even above 70° C.

Therefore the present invention provides a process for enzymatic removal of hydrophobic esters from fabrics, which process comprises treating the fabric with an effective amount of a thermostable lipolytic enzyme at an elevated temperature, i.e. a temperature elevated to a point exceeding the melting point of lubricant applied to the fabric.

As described above, enzymatic treatment of fabrics conventionally includes the steps of desizing the fabric by use of amylolytic enzymes, softening the garment (including the steps of bio-polishing, bio-stoning and/or garment wash) by use of cellulytic enzymes, optionally followed by dyeing the garment, washing the garment, and/or softening the garment with a chemical softening agent, typically a cationic, sometimes silicone-based, surface active compound. The process of the present invention may take place during any of these conventional garment manufacturing steps.

Accordingly, in a preferred embodiment, the process of present invention may be applied to the desizing step, whereby the invention provides a process for desizing fabrics, which process comprises treating the fabric at an elevated temperature with an effective amount of a thermostable lipolytic enzyme.

In another preferred embodiment, the process of present invention may be applied to the finishing step, whereby the invention provides a process for the finishing of fabrics, which process comprises treating the fabric at an elevated temperature with an effective amount of a thermostable lipolytic enzyme. The process of the invention for the finishing of fabrics may in particular be a applied to the step for softening of garments, to the bio-polishing step, to the stone-washing step or to the bio-stoning step, and/or to the garment wash step.

Fabrics

The process of the present invention applies to fabrics in general. In the context of this invention fabrics include fabrics or textiles prepared from man-made fibers, e.g. polyester, nylon, etc., as well as cellulosic fabrics or textiles.

The term "cellulosic fabric/textile" indicates any type of fabric, in particular woven fabric, prepared from a cellulose-containing material, containing cellulose or cellulose derivatives, e.g. from wood pulp, and cotton. The main part of the cellulose or cellulose derivatives present on the fabric is normally size with which the yarns, normally warp yarns, have been coated prior to weaving. In the present context, the term "fabric" is also intended to include garments and other types of processed fabrics. Examples of cellulosic fabric is cotton, viscose (rayon); lyocell; all blends of viscose, cotton or lyocell with other fibers such as polyester; viscose/cotton blends, lyocell/cotton blends, viscose/wool blends, lyocell/wool blends, cotton/wool blends; flax (linen), ramie and other fabrics based on cellulose fibers, including all blends of cellulosic fibers with other fibers such as wool, polyamide, acrylic and polyester fibers, e.g. viscose/cotton/polyester blends, wool/cotton/polyester blends, flax/cotton blends etc.

The process of the invention is preferably applied to cellulose-containing fabrics, such as cotton, viscose, rayon, ramie, linen or mixtures thereof, or mixtures of any of these fibers with synthetic fibers. In particular, the fabric may be denim. The fabric may be dyed with vat dyes such as indigo, direct dyes such as Direct Red 185, sulfur dyes such as Sulfur Green 6, or reactive dyes fixed to a binder on the fabric surface. In a most preferred embodiment of the present process, the fabric is indigo-dyed denim, including clothing items manufactured therefrom.

In a most preferred embodiment, the fabric subjected to the process of the invention is cotton garments, in particular dyed cotton garments or denim jeans.

Lipolytic Enzymes

The process of the present invention may be performed using any lipolytic enzyme that is capable of carrying out lipolysis at high temperatures. In order to efficiently hydrolyse hydrophobic esters of high melting points, lipolytic enzymes that possess sufficient thermostability and lipolytic activity at temperatures of about 60° C. or above, are preferred. Adequate hydrolysis can be obtained even above or below the optimum temperature of the lipolytic enzyme by increasing the enzyme dosage.

The lipolytic enzyme may be of animal, plant or microbial origin. Examples of microorganisms producing such thermostable lipolytic enzymes are strains of Humicola, preferably a strain of *Humicola brevispora*, a strain of *Humicola lanuginosa*, a strain of *Humicola brevis var. thermoidea*, a strain of *Humicola insolens*, a strain of Fusarium, preferably a strain of *Fusarium oxysporum*, a strain of Rhizomucor, preferably a strain of *Rhizomucor miehei*, a strain of Chromobacterium, preferably a strain of *Chromobacterium viscosum*, and a strain of Aspergillus, preferably a strain of *Aspergillus niger*. Preferred thermostable lipolytic enzymes are derived from strains of Candida or Pseudomonas, particularly a strain of *Candida antarctica*, a strain of *Candida tsukubaensis*, a strain of *Candida auriculariae*, a strain of *Candida humicola*, a strain of *Candida foliarum*, a strain of *Candida cylindracea* (also called *Candida rugosa*), a strain of *Pseudomonas cepacia*, a strain of *Pseudomonas fluorescens*, a strain of *Pseudomonas fragi*, a strain of *Pseudomonas stutzeri*, or a strain of *Thermomyces lanuginosus*.

Lipolytic enzymes from strains of *Candida antarctica* and *Pseudomonas cepacia* are preferred, in particular lipase A from *Candida antarctica*. Such lipolytic enzymes, and methods for their production, are known from e.g. WO 88/02775, U.S. Pat. No. 4,876,024, and WO 89/01032, which publications are hereby included by reference.

Process Conditions

The process of the present invention may be accomplished at process conditions conventionally prevailing in desizing and finishing processes, as carried out by the person skilled in the art. The process of the invention may be carried out using existing desizing and finishing equipment, e.g. a Pad-Roll, a Jigger/Winch, a J-Box, or Pad-Steam types of apparatus. However, in a preferred embodiment, the process of the invention is carried out batch-wise in a washer extractor.

As already described, the process of the invention should be carried out at a high temperature, i.e. a temperature elevated to a point exceeding the melting point of the lubricant applied to the fabric, in order to efficiently hydrolyse the hydrophobic esters (lubricants) of high melting points. In general, an elevated temperature indicates a temperature of above 50° C. However, in order to obtain a satisfactory product, the process may be carried out at a temperature of above 60° C., in particular above 65° C., above 70° C., or even above 75° C. In a preferred embodiment the process of the invention should be carried out at a temperature elevated to the range of from about 70 to about 100° C., more preferred the range of from about 75 to about 95° C., most preferred the range of from about 75 to about 85° C. At such elevated temperatures, the high melting point hydrophobic esters becomes more readily attacked by the lipolytic enzyme, thereby leading to a more efficient and rapid hydrolysis.

The enzyme dosage is dependent upon several factors, including the enzyme in question, the desired reaction time, the temperature, the liquid/textile ratio, etc. It is at present contemplated that the lipolytic enzyme may be dosed in an amount corresponding to of from about 0.01 to about 10,000 KLU/l, preferably of from about 0.1 to about 1000 KLU/l.

It is at present contemplated that a suitable liquor/textile ratio may be in the range of from about 20:1 to about 1:1, preferably in the range of from about 15:1 to about 5:1.

In conventional desizing and finishing processes, the reaction time is usually in the range of from about 1 hour to about 24 hours. However, in the process of the present invention, taking advantage of the elevated temperature, the reaction time may well be less than 1 hour, i.e. from about 5 minutes to about 55 minutes. Preferably the reaction time is within the range of from about 10 to about 120 minutes.

The pH of the reaction medium greatly depends on the enzyme in question. Preferably the process of the invention is carried out at a pH in the range of from about pH 3 to about pH 11, preferably in the range of from about pH 6 to about pH 9.

A buffer may be added to the reaction medium to maintain a suitable pH for the lipolytic enzyme used, The buffer may suitably be a phosphate, borate, citrate, acetate, adipate, triethanolamine, monoethanolamine, diethanolamine, carbonate (especially alkali metal or alkaline earth metal, in particular sodium or potassium carbonate, or ammonium and HCl salts), diamine, especially diaminoethane, imidazole, or amino acid buffer.

The process of the invention may be carried out in the presence of conventional textile finishing agents, including wetting agents, polymeric agents, dispersing agents, etc.

A conventional wetting agent may be used to improve the contact between the substrate and the lipolytic enzyme. The wetting agent may be a nonionic surfactant, e.g. an ethoxylated fatty alcohol. An example is the Berol Wash (product of Berol Nobel AB, Sweden), a linear primary C16–C18 fatty alcohol with an average of 12 ethoxylate groups. The wetting agent may be added to the lipolytic enzyme solution, or it may be used in a separate step prior to applying the lipolytic enzyme.

Examples of suitable polymers include proteins (e.g. bovine serum albumin, whey, casein or legume proteins), protein hydrolysates (e.g. whey, casein or soy protein hydrolysate), polypeptides, lignosulfonates, polysaccharides and derivatives thereof, polyethylene glycol, polypropylene glycol, polyvinyl pyrrolidone, ethylene diamine condensed with ethylene or propylene oxide, ethoxylated polyamines, or ethoxylated amine polymers.

The dispersing agent may suitably be selected from nonionic, anionic, cationic, ampholytic or zwitterionic surfactants. More specifically, the dispersing agent may be selected from carboxymethylcellulose, hydroxypropylcellulose, alkyl aryl sulphonates, long-chain alcohol sulphates (primary and secondary alkyl sulphates), sulphonated olefins, sulphated monoglycerides, sulphated ethers, sulphosuccinates, sulphonated methyl ethers, alkane sulphonates, phosphate esters, alkyl isothionates, acylsarcosides, alkyltaurides, fluorosurfactants, fatty alcohol and alkylphenol condensates, fatty acid condensates, condensates of ethylene oxide with an amine, condensates of ethylene oxide with an amide, sucrose esters, sorbitan esters, alkyloamides, fatty amine oxides, ethoxylated monoamines, ethoxylated diamines, alcohol ethoxylate and mixtures thereof.

In a particular preferred embodiment, the process of present invention may be applied in the desizing step. According to the invention it has been found that waxes and fats yield rather stable complexes, that is not sufficiently removed in a conventional desizing step. When applying a thermostable lipase together with a thermostable amylolytic enzyme, a synergistic effect was obtained. Hydrolysis of the triglycerides result in an improved starch removal, which leads to an increase in the accessibility of the natural impurities of the cotton in the subsequent process steps, in particular the scouring step.

Accordingly, the process may be accomplished in the presence of desizing enzymes, in particular thermostable amylolytic enzymes, in order to remove starch-containing size. In another preferred embodiment, the process may be accomplished in the presence of one or more bleaching agents, in particular hydrogen peroxide. These well known steps can be carried out as separate steps before or after the process of the invention, but advantageously one or both of these prior art processes can be combined with the process of the invention for removal of hydrophobic esters.

Therefore, an amylolytic enzyme, preferably an α-amylase, and/or a hydrogen peroxide or a hydrogen peroxide precursor may be added during the process of the invention. Conventionally, bacterial α-amylases are used for the desizing, e.g. an α-amylases derived from a strain of Bacillus, particularly a strain of *Bacillus licheniformis*, a strain of *Bacillus amyloliquefaciens*, or a strain of *Bacillus stearothermophilus*. Examples of suitable commercial α-amylase products are Termamyl™, Aquazym™ Ultra and Aquazym™ (available from Novo Nordisk A/S, Denmark).

The amylolytic enzyme may be added in amounts conventionally used in desizing processes, e.g. corresponding to an α-amylase activity of from about 100 to about 10,000 KNU/1. When an amylolytic is present during the desizing process of the invention, the pH of the reaction medium may preferably be within the range of from about pH 5 to about pH 8. Also, in a desizing process according to the present invention, 1–10 mM of Ca++ may be added as a stabilizing agent.

In order to carry out bleaching, the reaction medium may typically contain H2O2 at a concentration of from about 1 to about 30 g/l, and at a pH in the range of from about 8 to about 11. The reaction medium may also contain hydrogen peroxide stabilizers, e.g. sodium silicate and/or organic stabilizers, and a wetting agent/surfactant.

In another preferred embodiment, the process of present invention may be applied to the finishing step. Accordingly, the process of the invention may be accomplished in the presence of conventional enzymes and agents for softening of garments, including conventional enzymes and agents for bio-polishing, for stone-washing or for bio-stoning, and/or for garment wash.

Conventional enzymes are in particular cellulytic enzymes. The cellulytic enzyme may be derived from a strain of Humicola, a strain of Thermomyces, a strain of Bacillus, a strain of Trichoderma, a strain of Fusarium, a strain of Myceliophthora, a strain of Phanerochaete, a strain of Irpex, a strain of Scytalidium, a strain of Schizophyllum, a strain of Penicillium, a strain of Aspergillus, and a strain of Geotricum.

The cellulytic enzyme may be added in amounts conventionally used in finishing processes, e.g. corresponding to cellulytic activity of from about 10 to about 10,000 EGU/1.

Conventional finishing agents that may be present in a process of the invention include, but are not limited to pumice stones and perlite. Perlite is a naturally occurring volcanic rock. Preferably, heat expanded perlite may be used. The heat expanded perlite may e.g. be present in an amount of 20–95 w/w % based on the total weight of the composition.

Lipolytic Activity

The lipolytic activity may be determined using tributyrine as substrate. This method is based on the hydrolysis of tributyrine by the enzyme, and the alkali consumption is registered as a function of time.

One Lipase Unit (LU) is defined as the amount of enzyme which, under standard conditions (i.e. at 30.0° C.; pH 7.0; with Gum Arabic as emulsifier and tributyrine as substrate) liberates 1 mmol titrable butyric acid per minute (1 KLU= 1000 LU).

A folder AF 95/5 describing this analytical method in more detail is available upon request to Novo Nordisk A/S, Denmark, which folder is hereby included by reference.

Amylolytic Activity

The amylolytic activity may be determined using potato starch as substrate. This method is based on the break-down of modified potato starch by the enzyme, and the reaction is followed by mixing samples of the starch/enzyme solution with an iodine solution. Initially, a blackish-blue color is formed, but during the break-down of the starch the blue color gets weaker and gradually turns into a reddish-brown, which is compared to a colored glass standard.

One Kilo Novo alpha Amylase Unit (KNU) is defined as the amount of enzyme which, under standard conditions (i.e. at 37° C.+/−0.05; 0.0003 M Ca2+; and pH 5.6) dextrinizes 5.26 g starch dry substance Merck Amylum solubile.

A folder AF 9/6 describing this analytical method in more detail is available upon request to Novo Nordisk A/S, Denmark, which folder is hereby included by reference.

Cellulytic Activity

The cellulytic activity may be measured in endoglucanase units (EGU), determined at pH 6.0 with carboxymethyl cellulose (CMC) as substrate.

A substrate solution is prepared, containing 34.0 g/l CMC (Hercules 7 LFD) in 0.1 M phosphate buffer at pH 6.0. The enzyme sample to be analyzed is dissolved in the same buffer. 5 ml substrate solution and 0.15 ml enzyme solution are mixed and transferred to a vibration viscosimeter (e.g. MIVI 3000 from Sofraser, France), thermostated at 40° C.

One EGU is defined as the amount of enzyme that reduces the viscosity to one half under these conditions. The amount of enzyme sample should be adjusted to provide 0.01–0.02 EGU/ml in the reaction mixture.

EXAMPLES

The invention is further illustrated with reference to the following examples which are not intended to be in any way limiting to the scope of the invention as claimed.

Example 1

Desizing Experiments

In this example the process of the invention has been applied to a desizing process for the finishing of denim garments. Two comparative trials have been carried out, a desizing process accomplished in presence of a thermostable lipolytic enzyme (the process of the invention), and a conventional desizing process accomplished in absence of lipolytic enzyme.

The thermostable lipolytic enzyme used in this experiment was Lipase A obtained from *Candida antarctica* according to WO 88/02775 (Examples 2 and 10). 200 denim jeans (150 kg in total) were processed. The desizing was carried out as a batch process using a washer extractor.

Two desizing baths of the following composition were made:

1400 1 of hot water, 75° C.

Surfactant and lubricants, 9.25 1 of Lyoprep™ Extra (TS Chemical)

Amylolytic enzyme, 5.5 1 of Bioprep™ TBS (TS Chemical)

For carrying out the process of the invention, 0.9 KLU/l of lipolytic enzyme was added.

The desizing processes were carried out for 20 minutes. After draining off the desizing bath, the denim garments were rinsed two times in hot water of 60° C.

Afterwards, the garments of both trials were subjected to a softening process, using a softening bath of the following composition:

1400 1 of hot water, 60° C.

Cellulytic enzyme, 0.9 kg of Biosoft™ NTP (TS Chemical)

The softening processes were carried out for 30 minutes. After draining off the softening bath, the denim garments were rinsed in cold water.

Finally, the denim garments of both trials were subjected to dyeing using a solution containing black dyestuff (bifunctional reactives) and salt/soda. Excess dyestuff was washed off using a detergent solution (Palodet™ RDW), and a silicone softener (3% Palamine™ AOS) was applied to the denim garments.

When comparing the denim jeans from the two trials, the jeans processed according to the invention were much more soft and a much more even color distribution. Also, the level of crease marks was reduced significantly, as was the need for repair work.

Example 2

Desizing and Bio-Stoninig Experiment

In this example the process of the invention has been applied to both a desizing process and a Bio-Stoning process for the finishing of denim garments.

The thermostable lipolytic enzyme used in this experiment was Lipase A obtained from *Candida antarctica* according to WO 88/02775 (Examples 2 and 10). 150 denim jeans (112.5 kg in total) were processed. The desizing was carried out as a batch process using a washer extractor.

A desizing bath of the following composition were made:

800 1 of hot water, 75° C.

Surfactant and lubricants, 8 1 of Lyoprep™ Extra (TS Chemical)

Amylolytic enzyme, 4.5 1 of Bioprep™ TBS (TS Chemical)

Lipolytic enzyme. 1.5 KLU/l

The desizing process was carried out for 20 minutes. After draining off the desizing bath, the denim garments were rinsed in 400 1 of hot water, 60° C.

Afterwards, the garments were subjected to a bio-stoning process, using a bath of the following composition:

400 1 of hot water, 60° C.

1 kg perlite (TS Chemical)

Non-ionic surfactant base, 1 1Palanon™ BS (TS Chemical)

Cellulytic enzyme, 2 kg 800 NSK (TS Chemical)

Lipolytic enzyme, 3.0 KLU/l

The bio-stoning process was carried out for 40 minutes. After draining off the bath, the denim garments were subjected to a conventional wash off.

When compared to conventionally processes jeans, the jeans processed according to the invention showed significantly reduced number of crease marks, significantly better contrast (reduced back-staining), and absence of lubricant precipitates.

Example 3

Temperature Influence on Substrate Hydrolysis

This example shows the effect of increasing the temperature of a process for enzymatic removal of hydrophobic esters from fabrics.

Two different kinds of substrate were employed, a liquid substrate (reference) and a solid substrate. A reaction mixture was made based on 14.75 ml de-ionized water and 0.25 g stabilized glyceride substrate. The liquid substrate was a stabilized olive oil emulsion (available from Sigma Diagnostics), and the solid (non-melted) substrate was a commercial textile lubricant, TecWax™. To avoid product inhibition an additional 200 mmol of $CaCl_2$ was added to the reaction mixture.

The experiments were made at a pH of 7 that was held constant (ph-stat experiments) by titration with 10 mM NaOH using a TitraLab ABU91 equipment from Radiometer A/S (Copenhagen). When this ph-stat condition was reached, 5 LU of lipase (Lipase A obtained from *Candida antarctica* according to WO 38/02775, Examples 2 and 10) was added, and the extent of hydrolysis within the following 30 minutes was evaluated from the net consumption of NaOH.

Trials were made at 30, 40, 50, 60 and 70° C., respectively, and the results are presented in Table 1, below.

TABLE 1

Temperature Influence on Substrate Hydrolysis

| Substrate | 30° C. | 40° C. | 50° C. | 60° C. | 70° C. |
|---|---|---|---|---|---|
| Olive oil | +++ | +++ | +++ | +++ | ++ |
| TecWax | 0 | 0 | + | +++ | +++ |

0 denotes that no activity can be measured with the method employed.
+ denotes a small yet detectable hydrolysis (approx. less than 0.1 mmol NaOH consumed (per 5 LU lipase) within 30 minutes).
+++ denotes significant hydrolysis - more than approx. 0.1 mmol NaOH consumed (per 5 LU lipase) within 30 minutes.

The triglycerides used today in the textile industry are normally composed of modified tallow with a melting point between 50–60° C. For the commercial lubricant employed in this example, a melting point of 51° C. was determined by means of differential scanning calorimetry. As gathered from the above results, the lipase does not hydrolyze the glyceride substrate to a significant extent when the reaction temperature is below the melting point of the substrate.

Because many of the lipases known in the art loose a substantial part of their activity when employed at elevated temperatures, the use of lipases with high thermal stability are essential for this application, in part to give a reasonable extent of hydrolysis, and in part to make the technical process robust.

What is claimed is:

1. A process for enzymatic removal of hydrophobic esters from fabrics, which process comprises treating the fabric with an amount of a thermostable lipolytic enzyme effective to achieve removal of hydrophobic esters from fabric at a temperature of 75° C. above.

2. The process of claim 1, which process is accomplished in the presence of at least one non-lipolytic thermostable enzyme.

3. The process of claim 2, wherein the non-lipolytic thermostable enzyme is an amylolytic enzyme, a cellulytic enzyme, or both.

4. The process of claim 1, wherein the thermostable lipolytic enzyme is derived from a strain of Pseudomonas or a strain of Candida.

5. The process of claim 4, wherein the thermostable lipolytic enzyme is derived from a strain selected from the group of *Pseudomonas fragi, Pseudomonas stutzeri, Pseudomonas cepacia*, and *Pseudomonas fluorescens.*

6. The process of claim 4, wherein the thermostable lipolytic enzyme is derived from a strain of *Candida cylindracea* or a strain of *Candida antarctica.*

7. The process of claim 3, wherein the thermostable amylolytic enzyme is an α-amylase derived from a strain of Bacillus.

8. The process of claim 7, wherein the thermostable amylolytic enzyme is derived from a strain selected from the group of *Bacillus licheniformis, Bacillus amyloliquefaciens*, and *Bacillus stearothermophilus.*

9. The process of claim 3, wherein the thermostable cellulytic enzyme is derived from a strain selected from the group of Humicola, Thermomyces, Bacillus, Trichoderma, Fusarium, Myceliophthora, Phanerochaete, Irpex, Scytalidium, Schizophyllum, Penicillium, Aspergillus, and Geotricum.

10. The process of claim 1, which process is carried out in presence of hydrogen peroxide or a hydrogen peroxide precursor.

11. The process of claim 1, wherein the amount of lipolytic enzyme is from about 0.01 to about 10,000 KLU/l.

12. The process of claim 7, wherein the amount of lipolytic enzyme is from about 0.1 to about 1000 KLU/l.

13. The process of claim 7, wherein the α-amylase is in an amount of from about 100 to about 10,000 KNU/l.

14. The process of claim 3, wherein the cellulytic enzyme is in an amount of from about 10 to about 10,000 EGU/l.

15. The process of claim 1, wherein the process comprises a liquor/textile ratio in the range of from about 20:1 to about 1:1.

16. The process of claim 15, wherein the liquor/textile ratio is in the range of from about 10:1 to about 5:1.

17. The process of claim 1, wherein the treatment time is within the range of from about 10 minutes to about 24 hours.

18. The process of claim 17, wherein the treatment time is within the range of from about 10 minutes to about 55 minutes.

* * * * *